US010679590B2

(12) United States Patent
Moore et al.

(10) Patent No.: US 10,679,590 B2
(45) Date of Patent: Jun. 9, 2020

(54) TORSION ARM, CONNECTING ROD AND COIL CONFIGURATION IMPROVEMENTS FOR ACOUSTIC GUITARS AND OTHER STRINGED INSTRUMENTS

(71) Applicant: Angelic Guitars, L.L.C., Arnold, PA (US)

(72) Inventors: Dwaine Moore, Arnold, PA (US); Joseph S. DeSimone, Arnold, PA (US); Ralph A. DeSimone, Arnold, PA (US)

( * ) Notice: Subject to any disclaimer, the term of this patent is extended or adjusted under 35 U.S.C. 154(b) by 156 days.

(21) Appl. No.: 15/956,690

(22) Filed: Apr. 18, 2018

(65) Prior Publication Data

US 2018/0268788 A1 Sep. 20, 2018

Related U.S. Application Data

(63) Continuation-in-part of application No. 15/279,339, filed on Sep. 28, 2016, now Pat. No. 9,626,941.

(60) Provisional application No. 62/486,533, filed on Apr. 18, 2017.

(51) Int. Cl.
*G10D 3/02* (2006.01)
*G10D 3/10* (2006.01)

(52) U.S. Cl.
CPC ..... *G10D 3/02* (2013.01); *G10D 3/10* (2013.01)

(58) Field of Classification Search
CPC ..... G10D 3/02; G10D 3/10
USPC ..... 84/294
See application file for complete search history.

(56) References Cited

U.S. PATENT DOCUMENTS 9,570,051 B1 * 2/2017 Moore ..... G10D 3/02

* cited by examiner

*Primary Examiner* — Jianchun Qin
(74) *Attorney, Agent, or Firm* — Gary P. Topolosky

(57) ABSTRACT

A sound resonator device for internal connection to a guitar or other musical instrument that has strings tensioned over any type of bridge piece. The resonator device includes a torsion arm affixed to a sound board of the instrument from which is connected one or more involute coil sets, and a connecting rod. A first version employs coils having a circular section. A second variety uses at least one, thicker ribbon shaped coil configuration.

18 Claims, 6 Drawing Sheets

TORSION ARM, CONNECTING ROD AND COIL CONFIGURATION IMPROVEMENTS FOR ACOUSTIC GUITARS AND OTHER STRINGED INSTRUMENTS

CROSS-REFERENCE TO RELATED APPLICATIONS

This is a perfection of U.S. Provisional Application Ser. No. 62/486,533, filed on behalf of Angelic Guitars, L.L.C. on Apr. 18, 2017, that provisional also being a continuation-in-part of application Ser. No. 15/279,339, filed on Sep. 28, 2016, both disclosures of which are fully incorporated by reference herein.

FIELD OF THE INVENTION

The present invention relates to acoustic guitars and other stringed instruments. More particularly, it relates to a sound resonator device conveniently secured to the interior of a stringed musical instrument for enhancing the textural sounds achievable from playing that instrument. It may be assembled into the manufacture of new musical/audio products or carefully inserted into the retrofit/repair of existing guitars and other stringed instruments.

The resonator device of this invention rests in constant tension in a coiled and layered configuration. The device uses a uniquely designed waveform that is purposed to pull IN on itself, in an accordion-like fashion. The device attaches through a torsion arm interface that allows it to indirectly connect to any given plurality of instrument strings. At an opposite end, the plurality of coils connects to the instrument's soundboard via a connecting rod. Preferred embodiments of this invention provide a three stage or step assistance to sound quality: (1) an energy "pickup" component; (2) a sound "smoother" component; and (3) an energy "delivery" means. Installation of this device also nullifies a sizeable percentage of the high torque stresses that strings normally impart to the bridge regions of such instruments thereby greatly reducing fatigue and warping of the soundboard.

BACKGROUND OF THE INVENTION

To enhance the tonality of the sound box of a musical instrument, one may incorporate a common household spring that responds to the vibrations of its strings to give some resonant effect and modify the tones generated by plucking, strumming, striking or otherwise vibrating these strings.

It is further known in another design, that one might secure a large spring device to the frame of a guitar and suspending that spring vertically above the guitar strings over the outside top wall of the sound box and at a location in front of the bridge piece. A loop at the free end of this spring connects directly to two strings and vibrates with the strings to enhance the sound from the instrument. That spring device can be removed or disconnected if the original sound from that instrument is desired. Such a spring device has many disadvantages, however. It is unsightly; it intercepts string energy before it can benefit the soundboard, and is difficult to install. Known (large) spring connections are quite cumbersome. They also obstruct an area of the instrument where the user places his/her hand to pluck or otherwise activate the strings.

Relevant art to the present invention also includes the following disclosures, arranged chronologically: Sanns, Jr. U.S. Pat. No. 8,969,692, Aspri U.S. Pat. No. 8,222,503, LaMarra U.S. Pat. Nos. 7,838,752 and 7,488,878, Chiliacki U.S. Pat. No. 7,259,318, England U.S. Pat. No. 6,982,372 and Martin U.S. Pat. No. 6,646,191.

SUMMARY OF THE PRESENT INVENTION

It is a feature of the present invention to provide an improved sound reverberator device, particularly, one that permanently connects to the interior of a guitar (or other stringed instrument) at or below the bridge (or sound board) to that instrument. This invention would be easy to install in the manufacture of new products but can, with some degree of care, be added to existing guitars and the like for greatly enhancing the tonality of sound emanating from that instrument and greatly prolonging the life of its bridge/soundboard.

From a broad aspect, the present invention provides sound resonance by connecting to the guitar's interior a plurality of specially shaped pre-loaded INVOLUTE coils, each coil may wrap outwardly and may then wrap back inwardly about itself to form one section of resonation (an involute coil need not move both inward and outward, one direction is sufficient), with each pair of guitar strings having at least one resonator "set" comprised of a plurality (one or more) sections of spiraled resonator coils arranged IN SERIES and connected at one end to the underside, beneath the sound bridge of the instrument.

These multiple sets of coiled wire sections are secured between the guitar face and backing. Each coiled set of resonators would connect to the underside of the guitar's top soundboard, nearest the bridge, using a resonator torsion arm. These multiple involute coil configurations, a first set being a circular coil material variety and the second a thicker, ribbon shaped coil configuration, all improve the sound quality of guitars into which they are installed.

BRIEF SUMMARY OF THE DRAWINGS

Further features, objectives and advantages of the present invention will be clearer with the following detailed description made with reference to the accompanying drawings and photographs in which.

DESCRIPTION OF PREFERRED EMBODIMENTS

From a broad aspect, the present invention provides sound resonance by connecting to the guitar's interior one or more harmoniously selected, specially shaped coils, each coil wrapping in an involute manner in at least one direction, (though an involute may also wrap outwardly and then back inwardly about itself as well), to form an accordion-like section of resonation. These involute coils connect at one end via a torsion arm (either integrally formed with one or more of the coils, or made as a separate, stand alone connection that gets joined to the combination of involute coil sets), and at another connection point via a connecting rod, preferably perpendicular to an inside face of the guitar proper. Together, these three main components provide the guitar with means for energy pickup (via the torsion arm), smoothing (via the involute coil sets) and delivery back to the sound board (via the connecting arm).

The invention is flexible in that varying embodiments may include one set of involute coil connections per guitar string, at least one resonator "set" for multiple sections (two or more) strings or as many coil connection sets as number of strings so that each string has its own dedicated involute coil arrangement. One embodiment for a six-string guitar may have a first involute coil for the first two strings, a second coil set for the middle two strings and a third, separate coil for the last two strings of the guitar. Alternately, a first coil set could be dedicated to its own string of the guitar, a second coil to a pair of strings and a third coil set affiliated with the remaining THREE strings of the same acoustic instrument.

In the accompanying drawings, there is shown a set of spiraled resonator coils that are arranged IN SERIES and connected via a rotatable (angled) torsion bar or arm (made of wood or metal) to the lower end, underside, of the bridge of the instrument.

Figure 1:
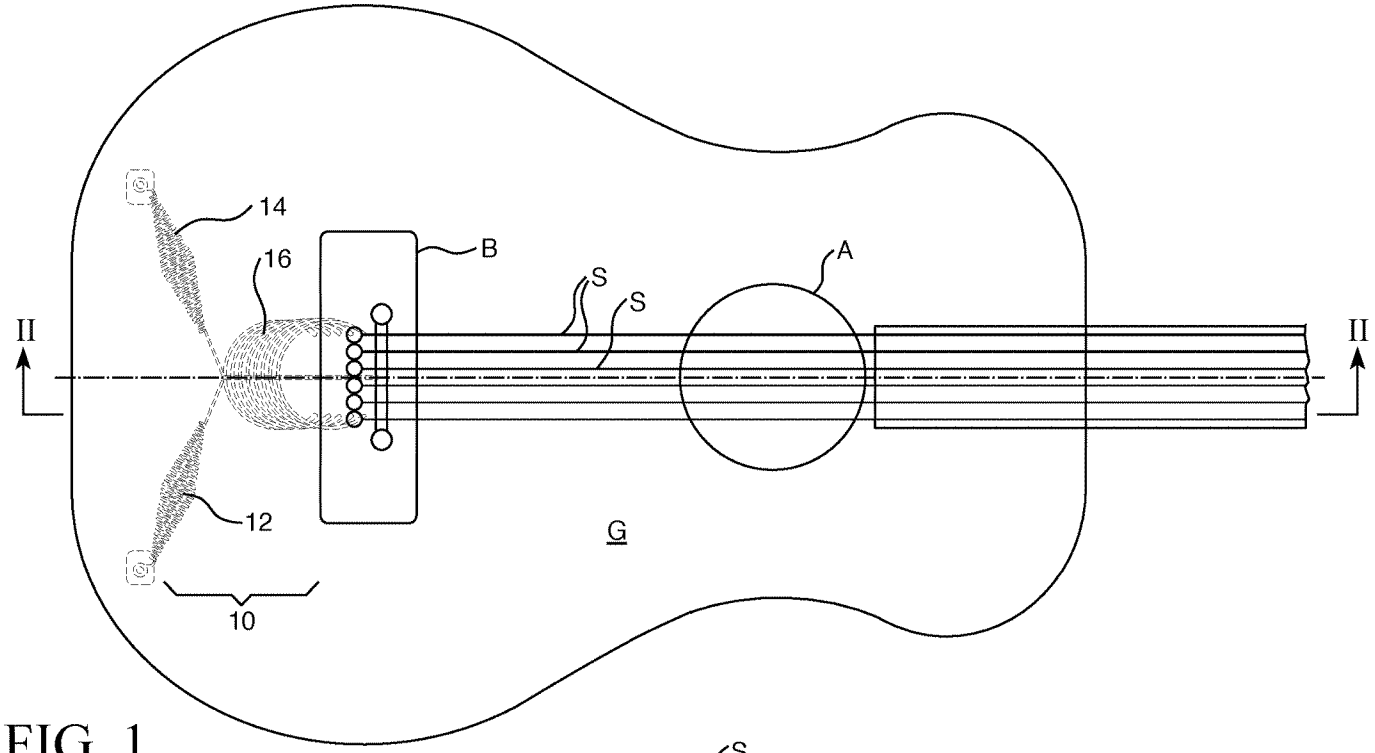
FIG. 1 is a top plan view of the lower end of an acoustic guitar showing three involute coils connected in a multiple angular manner per one embodiment of this invention.
Figure 2:
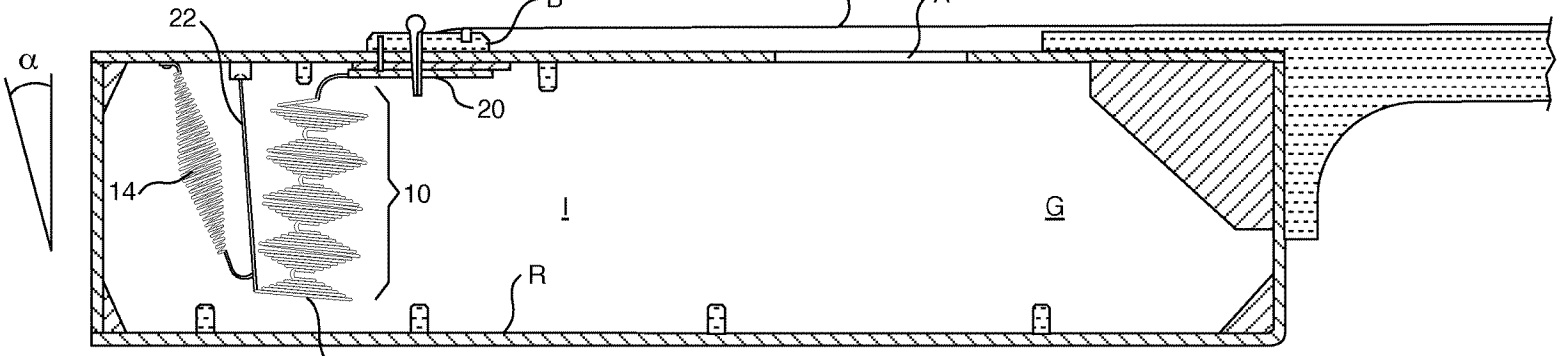
FIG. 2 is a side sectional view taken along lines II-II of FIG. 1.
Figure 3:
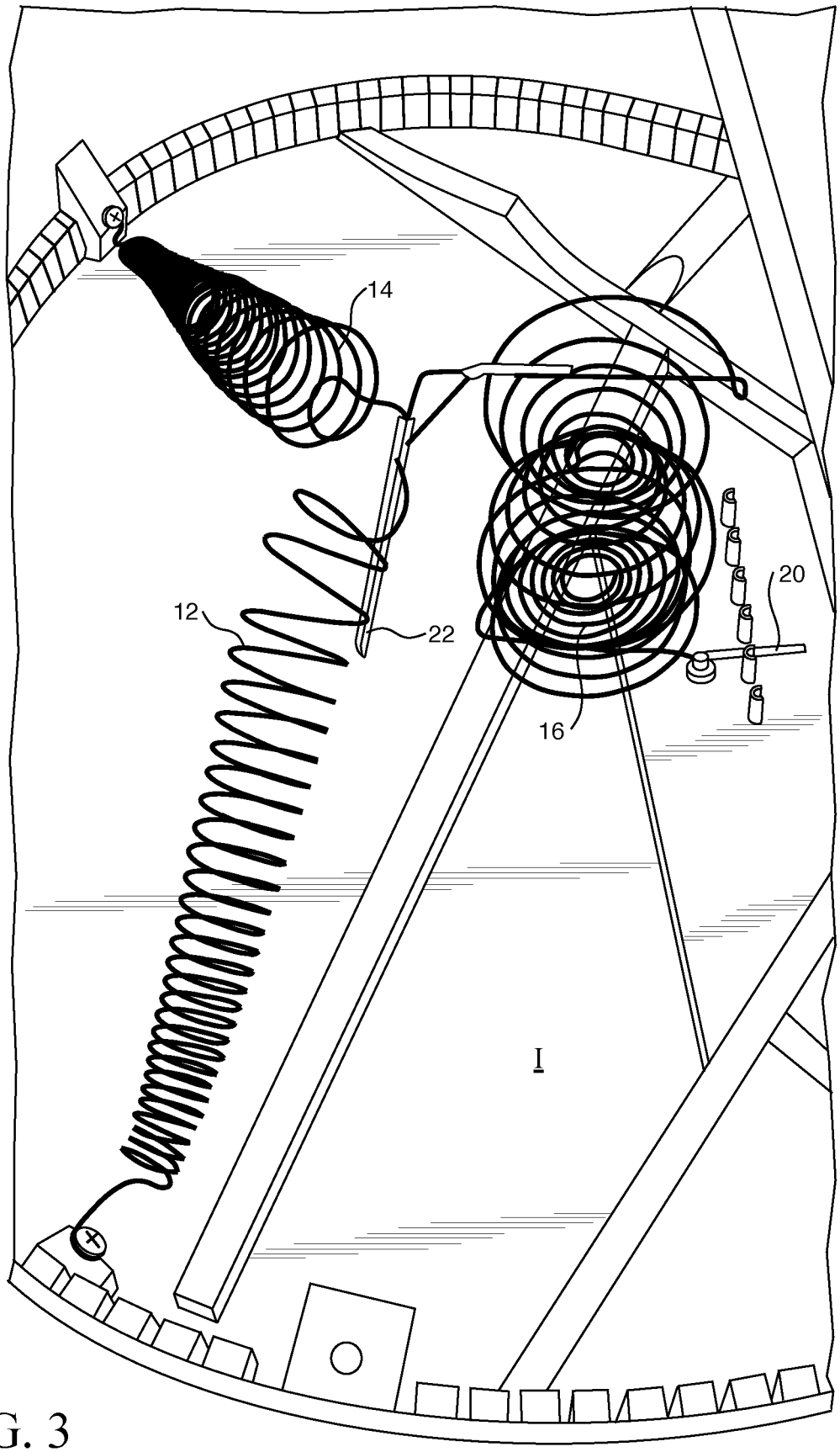
FIG. 3 is a top perspective view of the torsion arm, 3 involute coil sets and connecting rod installed in an acoustic guitar.
Figure 4:
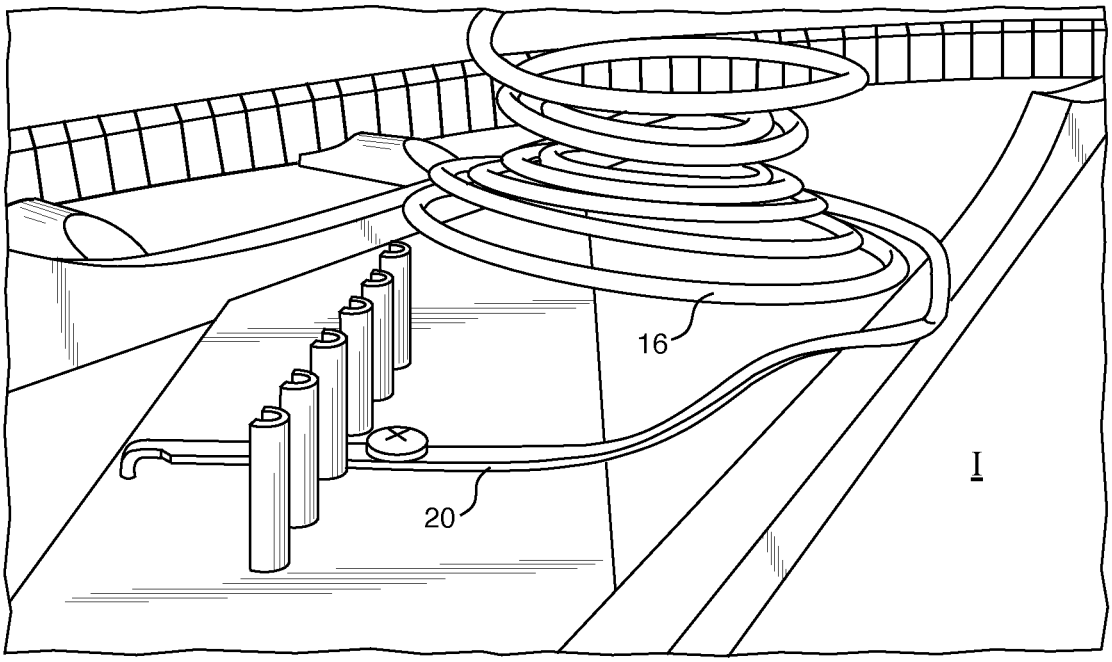
FIG. 4 is a side view of the torsion arm installed between string connections of the guitar's interior bridge backing plate.
Figure 5:
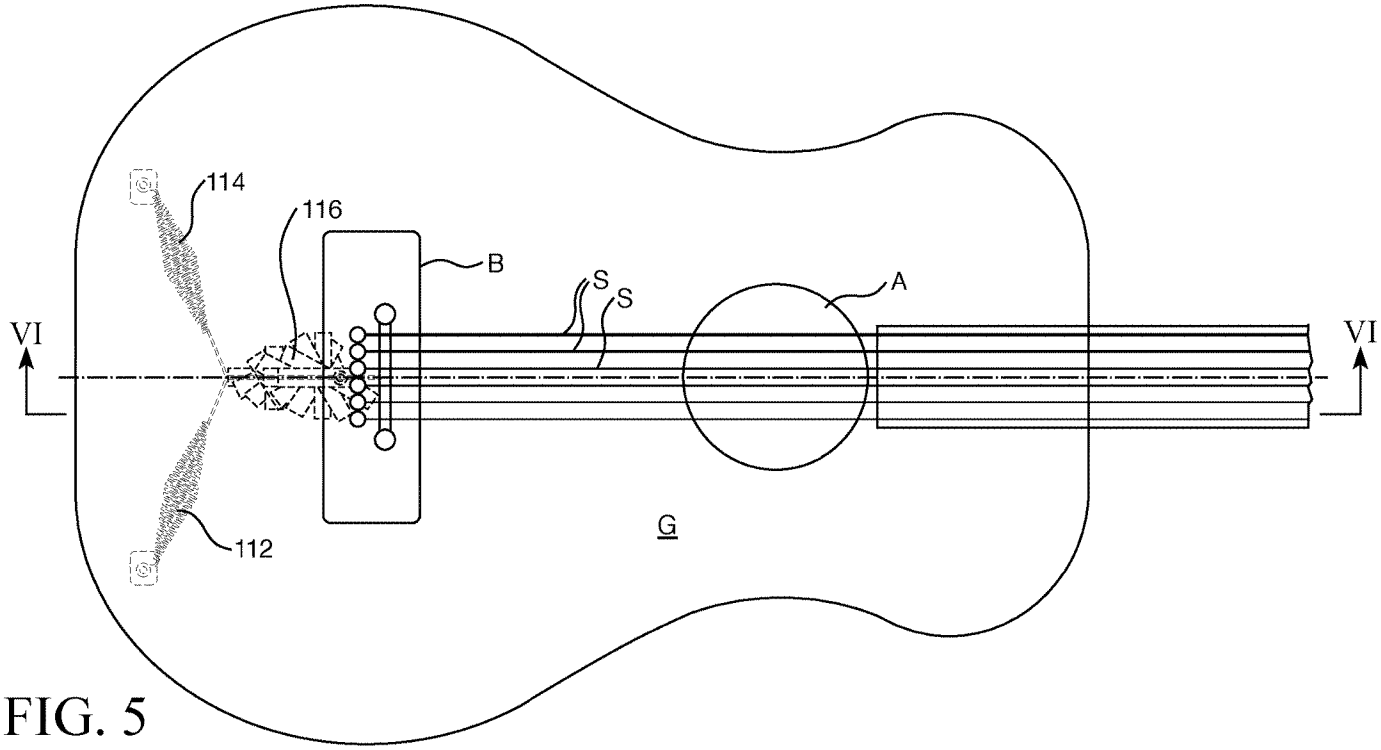
FIG. 5 is a top plan view of the lower end of a second acoustic guitar showing three involute coils, one of which is ribbon-shaped and connected in a triangular manner per another embodiment of this invention.
Figure 6:
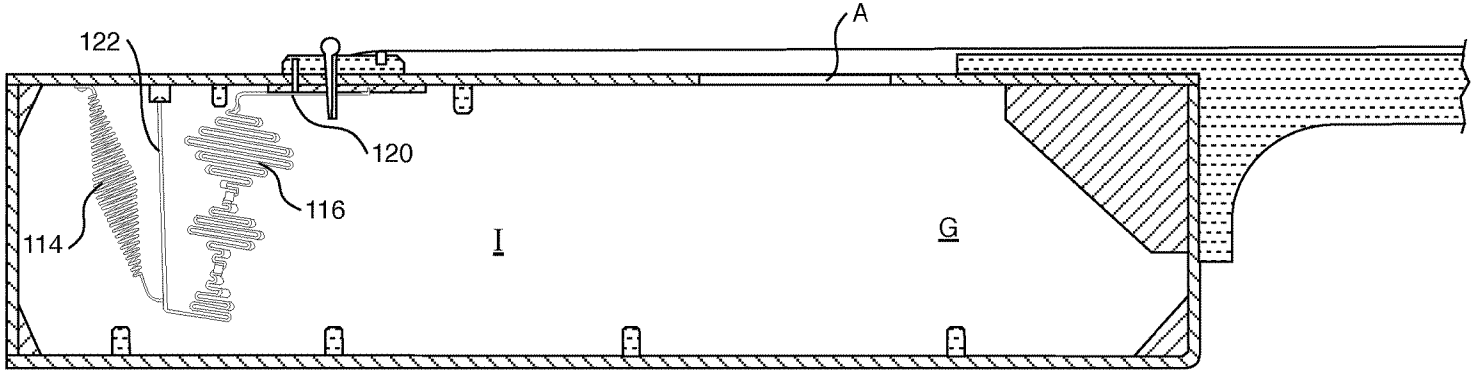
FIG. 6 is an enlarged side sectional view taken along lines VI-VI of FIG. 5.
Figure 7:
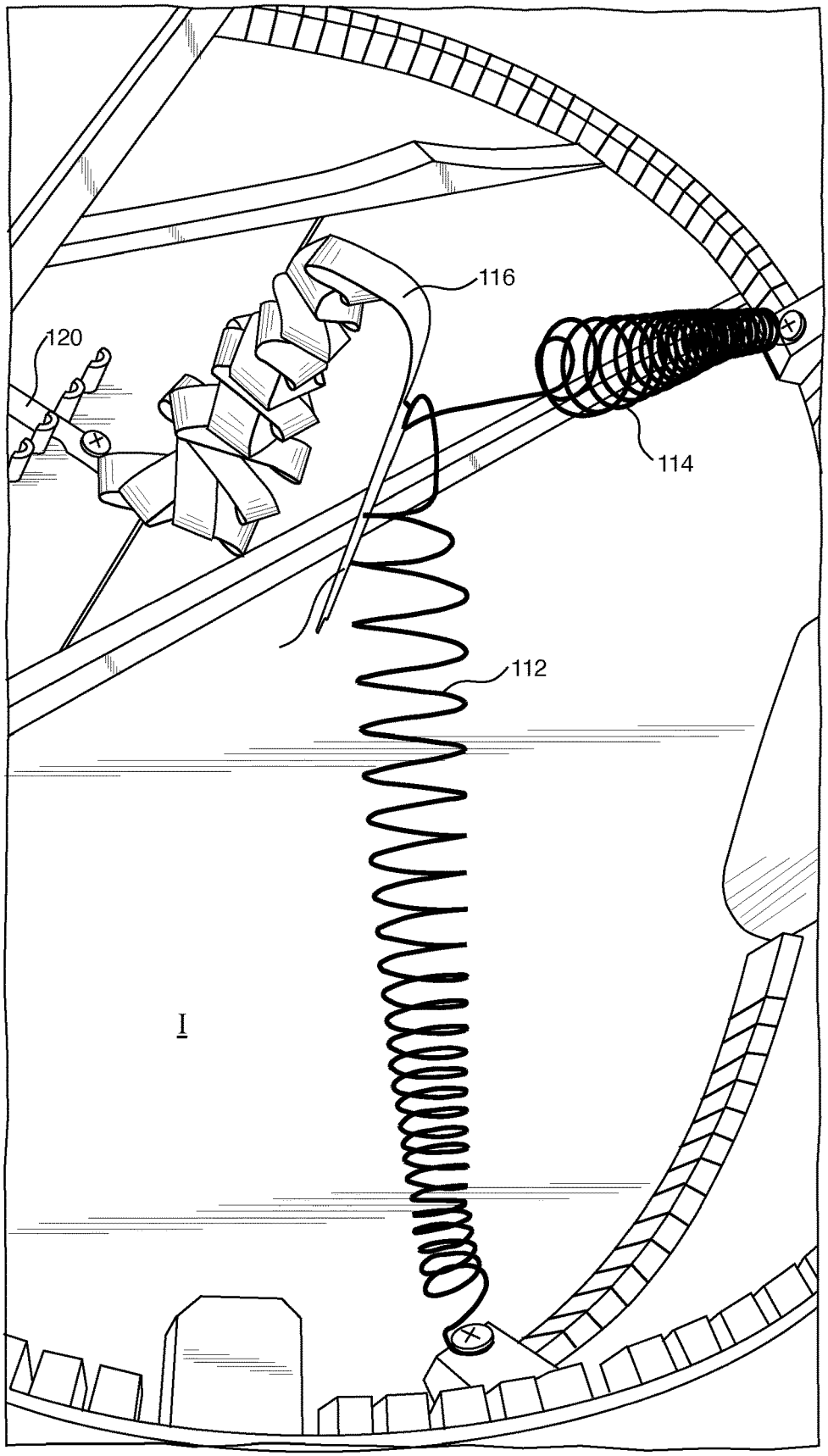
FIG. 7 is a top perspective view of the main components from FIGS. 5 and 6 installed in the interior of an acoustic guitar.
Figure 8:
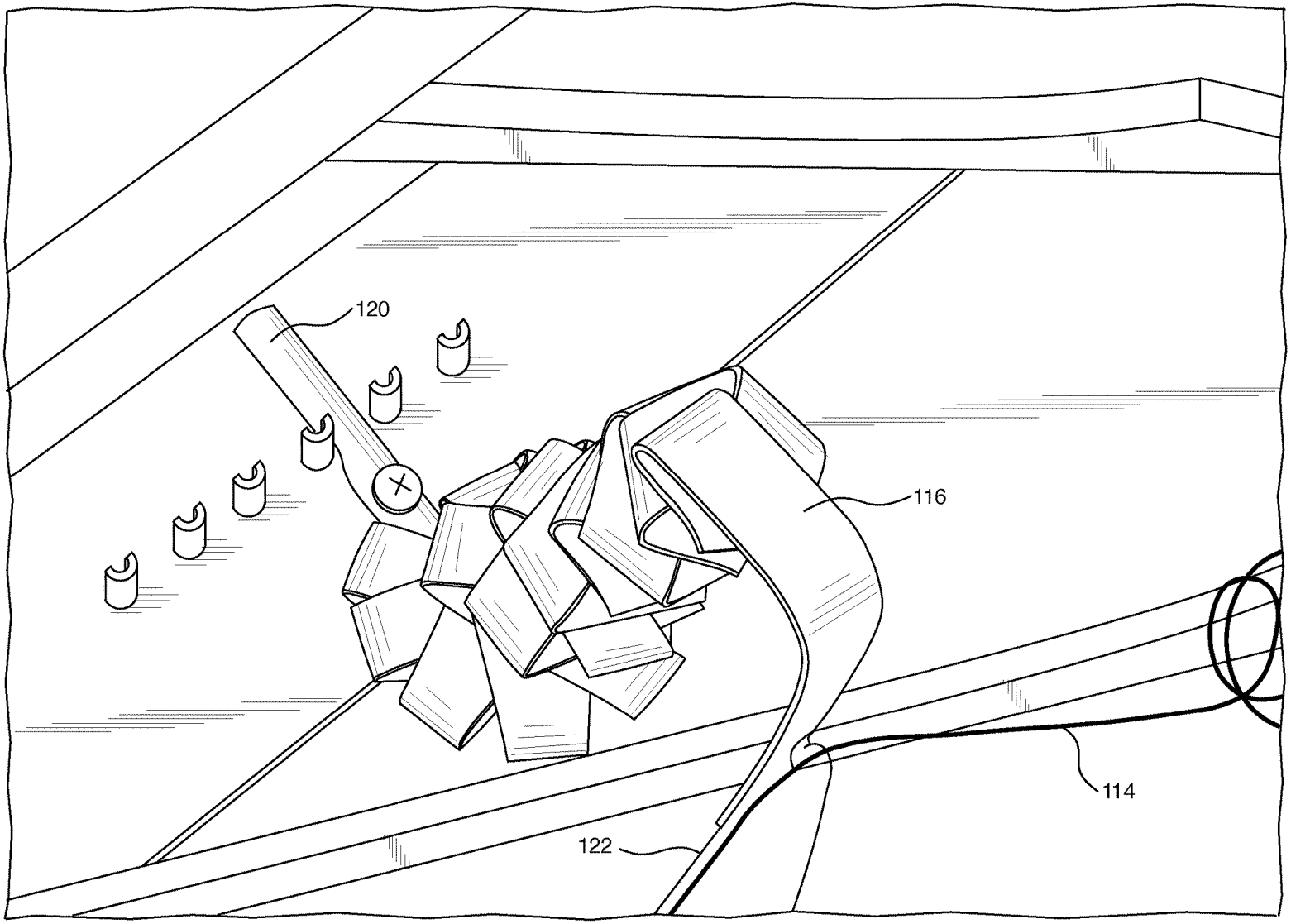
FIG. 8 is a top perspective view of a torsion arm and the involute, ribbon coil from which it extends.

These multiple sets of coiled wire sections are secured between the guitar face and guitar back. Each coiled set of resonators would connect to the underside of the guitar's top soundboard, nearest the bridge, using a resonator torsion bar or arm (made of wood or metal). That arm can be mounted to the underside at an angle ranging from about 5 to 175 degrees from the horizontal plane of that bridge. A second angle of tilt, a in FIG. 2, may range from about 5 to 89 degrees on either side of perpendicular and may be used for preferential positioning of any one or more torsion arms relative to the longitudinal directional plane of guitar string attachment to that same bridge. Yet a third angle shows the relative mounting of the involute coil sets from the inside of the front face of the instrument to its lowermost connecting point (either directly to the rear wall of the guitar or via connecting pins to a rearward most mounting point). That third angle is typically perpendicular to the bridge and rear wall in most instances. But it can also vary by as much as 45 degrees, preferably 30 degrees or less, tilted away from perpendicular.

While the respective involute coil sets can be made in individual units and connected, in series, to one another, it is preferred that they instead be made as one continuous unit of metal wire having a circular cross-section (as per FIGS. 1 through 4). A ribbon-shaped alternative arrangement, also made from metal, is depicted in accompanying FIGS. 5 through 8.

Referring to FIGS. 1 through 4, there is shown a first embodiment of improved sound resonator device, generally 10, secured to the interior I of an acoustic, six-string (or "classical") guitar G. As shown, device 10, is made from three subcomponent coils 12, 14 and 16, the first two being connected directly to the underside of the guitar interior I and the third, coil 16, being joined via its own torsion arm 20 to an underside of one or more strings S of guitar G disposed rearward of its bridge B located rearward of an aperture A for the guitar's sound box. All three coils of this first embodiment, meet at one common end, closer to the rear soundboard wall R of the guitar interior I where they all join to a common connecting rod 22.

The three sets of resonators employed within guitar G are purposefully spaced from one another. They are NOT meant to contact each other in any manner. As mentioned earlier, it is ideal to incorporate such resonator sets in the NEW construction of a guitar. It is to be understood, however, that resonators may also be carefully inserted into an existing unit, albeit by labor intensive retrofitting.

With the sound resonator devices installed as shown, the tension applied onto the standard bridge B of guitar G will be lessened. As for the resonators, when a string S on guitar G is plucked, it imparts a vibration that will be transmitted to the sound box via the bridge piece B. With the invention, however, that same vibration will now be transferred, via torsion arm 20 to its own involute coil set 16 for that string (or strings) for a functional energy storage and retransmission. The coil set is thus set into vibration and that vibration gets transmitted back and forth and eventually into either the back soundboard or the front soundboard via connecting rod 22, with some residual effects re-entering the bridge area as well. The added vibration areas provide a resonant sound and amplify, give volume, prolong and further modify the tones usually generated by the vibrated string of that instrument alone.

Referring now to FIGS. 5 through 8, it should be noted that common elemental components between the various embodiments are commonly numbered, though in the next hundred series.

FIGS. 5 through 8 show a guitar body G having inside two involute coil sets 112 and 114 connected to various interior points of the instrument. The third coil 116 that commonly connects thereto, via rod 122, is actually ribbon-shaped. It, in turn, connects to the bridge area via torsion arm 120. Because of the ribbon shaping of this main coil, a different, fuller sound results. That sound will change depending on the number of ribbon folds, metal used to make coil 116 and its connection points to the remainder of the guitar interior I.

For 12 string guitars, for example, additional sets of resonators may be added. And for instruments with fewer than six strings, a banjo, violin, bass, etc., there may be acceptable reductions (or increases) in the number of resonators installed thereunder.

There will be some preferred materials of choice to make respective SETS of involute resonator coils but certainly, as one preference, all three sets may be made from a common metal/metal alloy, in different thicknesses of wire product, specially coiled outwardly then intentionally inwardly, with the coil "wave frequency" (or pitch) varying, even within any given coil. Suitable wire materials for these reciprocating coil windings can be made in harmoniously matched sets, just as the surface strings of the instrument proper are in matched sets, made from beryllium copper alloys, stainless steel, medium carbon steels, phosphorus bronze, copper, aluminum or brass. Other materials may be customizable therefrom based on cost of manufacture versus desired degree of sound improvement sought.

The three sets of involute resonators employed within the guitars shown are purposefully spaced from one another. They are NOT meant to contact each other in any manner. As mentioned earlier, it is ideal to incorporate such resonator sets in the NEW construction of a guitar. It is to be understood, however, that resonators may also be carefully inserted into an existing unit, albeit by labor intensive retrofitting.

It should be noted first, that an alternate variety of torsion arm can be similarly shaped, though made from wood (or possibly even composite materials). But, the torsion arm can be customized for attaching to the guitar interior at a variety of angles. First, there is the angle that CAN range from about 5 to 175 degrees from the horizontal plane of bridge.

Secondly, the angled summary to the right of torsion arm shows yet a second variation in angle mountings, that angle, ranging from about 5 to 89 degrees on either side of perpendicular, may be used for preferential positioning of any one or more torsion arms relative to the longitudinal directional plane of guitar string attachment.

Though the resonator device of this invention is shown attached to a typical acoustic guitar, the device may also be used with other string instruments such as violins, mandolins, basses, etc.

This device was first purposed for the sound reproduction qualities that are (in and of themselves) unique and long overdue. In its concept, however, it also serves the dual function of lessening torsion stresses on the guitar's bridge area, an infamously well-known headache for guitar manufacturers. That is where traditional bridgework often pulls away from and/or physically distorts the soundboard over an instrument's lifetime. The design of this invention greatly reduces the stresses on those areas for many musical instrument applications. It re-directs these traditionally unwanted stresses into a shock absorption-and-transfer mechanism that not only cancels out a large percentage of such torsional stresses on the bridge area, but also better utilizes previous wasted energies in achieving beneficial harmonics amplification and sound wave sustain/boosting efficiencies.

Overall, the two-fold intent behind this resonator system enhancement is to:

1. capture and utilize previous wasted energies coming from the vibrating strings and transfer that energy in varying harmonic time lags to the back sound board, back to the top soundboard, etc., etc., thereby richly adding to the harmonic resonance of the frequencies being played on the surface, and 2. counter a substantial portion of the harmful moment-arm stresses acting upon the delicate bridge area of traditional instruments.

In doing so, this concept: helps produce a better free-floating membrane; allows for lighter, more delicate construction characteristics of the front soundboard, which leads to greater sound amplification and clarity; while further expanding the frequency response on the initial vibrations themselves, where the top soundboard clarity and amplification are increased even when effects are dampened.

Further improvements and/or advantages of this latest set of variations include its ability to bring a heavenly sound "down to earth". It creates a natural reverb guitar that has: 1. an amazing new sharper sound and increased volume from a compact, single piece assembly; 2. an overall weight of less than 80 grams; 3. an improved durability (especially under brutal shipping carelessness and/or for musicians with exceptionally vigorous playing styles); 4. an ability to be easily installed with no connections to any other place but the underside of the front soundboard, if so desired; 5. very few screws to install or remove (for instance, only 3 screws for the 3 spring system representatively depicted in the accompanying drawings—though 2 or 4 screws may also suffice therefor); 6. no tight tolerances or adjustments to make; 7. components that can be mass produced; 8. a more universal application to fit most any guitar; 9. greatly reducted impact sounds if mishandled; and 10. a more impressive "look" when one peeks inside the guitar in which it is installed.

In addition to the foregoing main benefits, this invention achieves limitless organic 'textural' effects through this breakthrough marriage of innovative physics. Thanks to these layered/involute coil designs, it is possible to produce much more than just a single frequency sustain. An unlimited variety of tonal 'textures' can now be achieved simply by incorporating any number of complimentary combinations of such layered resonators, adjusting their coil shape, size and gauge (including an occasional straight wound coil added to any multiple involute coil assembly). Then further harmonizing the number of such resonator sets that can be blended into each unit.

One of the basic principles of resonance, called "sympathetic vibrations", states that a vibrating body of one frequency, i.e., the transmitter, will transfer its own vibrations through air (or through transmittal objects with a solid mass) to a nearby body with the same frequency characteristics, the receiver, causing that secondary receiving object (or objects) to vibrate in unison with the sender. This inventive design incorporates an involute form, offering an infinite number of receivers (and secondary transmitters) for such frequencies.

The acoustic behavior behind this design's special "layered" resonator construct has a unique and beneficial quality. The infinitely varying coil diameters and its unique pitch between coil waves (or its "spreads") result in a sound interaction not found with ordinary reverberating springs. These new resonator designs can mimic and reflect any frequency being created within the instrument including what guitarists understand as "bent" notes. In other words, the frequencies achievable herewith are not limited to what a routine single diameter coil winding is narrowly able to imitate.

The infinitely varying layers of these spiraled coil sets will also react with one another in a way where they can "bounce against one another" adding very slight but discernible "chorus", "tremolo", "warmth" and other octave enhancing effects adding "textures", making the final result much more "interlaced with sound" than a simple monotone sustain. Each varying resonator, its gauge, and each stacked layer thereof then act as a separate and individually unique contributing "delay wave" in reaction to any of the given frequencies produced on the surface strings of said guitar. The cumulative effect adds a "warmth" that is pleasantly unprecedented in an organic, acoustic instrument.

Having described the presently preferred embodiments, it is to be understood that the invention may also be covered by the scope of the appended claims that follow.

What is claimed is:

1. A sound resonator device for a musical instrument that has a plurality of strings tensioned over a bridge piece connected to a soundboard, said soundboard having an interior face and an exterior face, said resonator device comprising:

(a) a torsion arm for picking up energies from when one or more strings of the musical instrument have been stroked or strummed;

(b) at least two involute coil sets, each involute coil set including a first component that forms a harmonic section capable of capturing a range of frequency energies when one or more strings of the musical instrument are stroked or strummed for smoothing sounds eventually delivered to another area of the soundboard, each of said at least two involute coil sets being connected at a first end to the torsion arm; and (c) a connecting rod for subsequently delivering smoothed sounds through the at least two involute coil sets to the soundboard, said at least two involute coil sets being connected to the connecting rod at their opposed ends.

2. The resonator device of claim 1 wherein at least one of the involute coil sets includes two or more harmonic sections.

3. The resonator device of claim 1 wherein the torsion arm is integrally formed as a part of the at least two involute coil sets.

4. The resonator device of claim 1 wherein the connecting rod is integrally formed as a part of the at least two involute coil sets.

5. The resonator device of claim 1 wherein the musical instrument is a new instrument.

6. The resonator device of claim 1 wherein the musical instrument is an existing instrument for retrofitting.

7. The resonator device of claim 1 wherein the musical instrument is an acoustic guitar.

8. The resonator device of claim 1 wherein the musical instrument is an instrument selected from the group consisting of a banjo, a violin, a bass, a cello, a mandolin, a fiddle and a ukulele.

9. The resonator device of claim 1 wherein the involute coil set is made from a metal alloy selected from the group consisting of phosphor bronze, steel, copper and aluminum.

10. The resonator device of claim 1 wherein at least one of the involute coil sets is made in a continuous ribbon shape with multiple metal folds.

11. A sound resonator device for a guitar that has a plurality of strings tensioned over a bridge piece connected to a soundboard, said soundboard having an interior face and an exterior face, said resonator device comprising: (a) a torsion arm for picking up energies from when one or more strings of the guitar have been stroked or strummed; (b) two or more involute coil sets, each coil set including a first component that forms a harmonic section capable of capturing a range of frequency energies when one or more strings of the guitar are stroked or strummed for smoothing sounds eventually delivered to another area of the soundboard, each of said involute coil sets being connected at a first end to the torsion arm and at an opposed end near one another; and (c) a connecting rod for subsequently delivering smoothed sounds through the involute coil sets to the soundboard, said two or more involute coil sets being connected to the connecting rod at their opposed ends.

12. The resonator device of claim 11 wherein the two or more involute coil sets are spaced and angled apart from each other.

13. The resonator device of claim 11 wherein the torsion arm is integrally formed as a part of the two or more involute coil sets.

14. The resonator device of claim 11 wherein the connecting rod is integrally formed as a part of the two or more involute coil sets.

15. The resonator device of claim 11 wherein the musical instrument is a new acoustic guitar.

16. The resonator device of claim 11 wherein the two or more involute coil sets are made from a metal alloy selected from the group consisting of phosphor bronze, steel, copper and aluminum.

17. The resonator device of claim 11 wherein the two or more involute coil sets are made from a wire product having a circular or oval cross-sectional shape.

18. The resonator device of claim 11 wherein the two or more involute coil sets are made from a product having a ribbon-shaped cross-section with multiple metal folds.

* * * * *